United States Patent [19]

Topness et al.

[11] Patent Number: 4,671,734

[45] Date of Patent: Jun. 9, 1987

[54] DUAL TURBINE DRIVE

[75] Inventors: Paul C. Topness, Renton; Bobby L. McGehee, Seattle; Roy Woodcock, Rochester, all of Wash.

[73] Assignee: The Boeing Company, Seattle, Wash.

[21] Appl. No.: 883,298

[22] Filed: Jul. 2, 1986

Related U.S. Application Data

[63] Continuation of Ser. No. 659,982, Oct. 12, 1984, abandoned.

[51] Int. Cl.[4] ..... F01D 1/24

[52] U.S. Cl. ..... 415/69

[58] Field of Search ..... 60/39.08, 39.15, 224, 60/263, 39.183, 698, 716, 39.163; 415/61, 67, 68, 69, 142

[56] References Cited

U.S. PATENT DOCUMENTS

| | | | |
|---|---|---|---|
| 2,639,579 | 5/1953 | Willgoos | 60/39.08 |
| 2,838,913 | 6/1958 | Peterson et al. | 60/39.15 |
| 2,852,917 | 9/1958 | French | 60/39.08 |
| 2,930,190 | 3/1960 | Rogers | 60/39.15 |
| 3,312,448 | 4/1967 | Hull, Jr. et al. | 60/39.08 |
| 3,313,104 | 4/1967 | Evans et al. | 60/39.163 |
| 3,368,347 | 2/1968 | Wickman | 60/39.163 |
| 3,527,054 | 9/1970 | Hemsworth | 60/39.08 |
| 3,744,241 | 7/1973 | Muller et al. | 60/39.163 |

FOREIGN PATENT DOCUMENTS

| | | | |
|---|---|---|---|
| 2046849 | 11/1980 | United Kingdom | 415/142 |

*Primary Examiner*—Carlton R. Croyle
*Assistant Examiner*—Donald E. Stout
*Attorney, Agent, or Firm*—James P. Hamley; Bernard A. Donahue

[57] ABSTRACT

A pair of cold air driven tubines are mounted in-line with each turbine driving one of two coaxial drive shafts. Each drive shaft is independently supported and separate drive air is supplied to each turbine such that the direction and speed of rotation of each drive shaft is independently controlled. Exhaust air from the forward turbine vents through an exhaust cavity that surrounds the aft turbine. Inlet drive air to the aft turbine is supplied via air ducts formed through the center of struts which extend radially from the inlet of the aft turbine, through the exhaust cavity and to an inlet port external to the turbine housing.

9 Claims, 3 Drawing Figures

DUAL TURBINE DRIVE

This is a continuation of application Ser. No. 659,982, filed Oct. 12, 1984, now abandoned.

BACKGROUND OF THE INVENTION

The present invention pertains to the fluid driven turbine art and, more particularly, to a cold air, dual turbine drive.

Numerous turbine configurations are known to the prior art. Turbines are commonly employed to convert a fluid flow to rotation of the drive shaft. A particular application for turbines is in the testing of fans or propellers for use in aircraft. Ideally, the propeller or fan under test should be driven at speeds normally expected in its intended application. Further, the test structure behind the fan or propeller should be aerodynamically similar to the structure encountered in the actual application, such that flow patterns past the fan or propeller can be simulated. In addition, the drive source to the fan or propeller should be sufficiently quiet such that noise levels produced by the fan or propeller can be accurately measured.

A particular need in this art has been a requirement for a drive capable of the static testing of counter-rotating shafts over a broad RPM range and with sufficient horsepower to simulate the speeds actually encountered by such propellers.

Heretofore, the drives for testing counter-rotating propellers have suffered from numerous deficiencies. For example, hot gas turbine drives have been used in propeller testing, but the size of the hot gas turbines required to drive counter-rotating propellers to realistic levels has been so large that such turbines have blocked airflow behind the fan or propeller, thereby obstructing accurate airflow measurements. In addition, hot gas turbines are noisy, tending to mask the noise from the propeller under test.

A further problem associated with hot gas turbines is that they are designed to operate within a specific RPM range and do not provide a high output for speeds "off" this range. As such, the use of hot gas turbines has proved inappropriate for testing propellers over their entire operating range.

Additionally, electric motors have been employed in propeller testing. Here, as with gas turbines the electric motors required to drive propellers to realistic levels have been so large that they, also, block airflow behind the propeller. While attempts have been made in locating the motor in an adjacent location to the test propeller with drive shafts and gearing extending in a linkage from the motor to the propeller, the losses encountered in such construction have proved intolerable, as has the cost of the linkage.

There is a long-felt need in the aircraft propeller and fan testing art, therefore, for a turbine design which exhibits a useful power output over a broad RPM operating range, which is both quiet and compact in configuration, and which is capable of driving counter-rotating propellers.

SUMMARY OF THE INVENTION

The present invention, therefore, is directed to a dual turbine drive which is highly efficient, compact in configuration, exhibits low noise characteristics and is capable of producing a useful power output over a broad RPM range.

Briefly, according to the invention, a dual turbine drive comprises first and second coaxial drive shafts, first and second fluid driven turbines, and a housing for the drive shafts and the turbines. The first and second turbines are configured in-line along the drive shafts with the first turbine forward of the second turbine. The drive from the first turbine is connected to the first drive shaft, with the drive from the second turbine being connected to the second drive shaft. A first turbine exhaust means routes the exhaust from the first turbine to a port aft of the second turbine. The first turbine exhaust means includes an exhaust cavity defined at its inner surface by the external surface of the second turbine and at its outer surface by the inner surface of the housing. Inlet drive fluid is provided independently to the first and second turbines. The inlet drive to the second turbine includes a duct which extends from the inlet of the second turbine through the first turbine exhaust cavity to a port accessible on the outside of the housing.

The first turbine exhaust cavity is, preferably, annular in cross section with a substantially constant cross-sectional area extending frusto-conically from the output of the first turbine to a substantially cylindrical configuration surrounding the second turbine.

Fluid drive to the second turbine is, preferably, provided by a plurality of radial struts which are positioned intermediate the turbines and substantially within the frusto-conical portion of the exhaust cavity, with each strut being provided with a fluid duct for routing inlet fluid drive to the second turbine.

Each of the second turbine inlet ducts is preferably contoured with an aerodynamic outer surface for minimizing the exhaust flow losses from the first turbine through the exhaust cavity.

First and second bearing sets are, preferably, provided for independently supporting the first and second drive shafts, respectively, such that the direction and speed of rotation of the shafts are independent.

Lubricant too at least a portion of the bearing sets is provided through a lubricant flow path within at least one of the struts.

An exhaust splitter is, preferably, provided for limiting the interaction between the exhausts from the turbines. This exhaust splitter is preferably cylindrical and extends aft from the exhaust of the second turbine.

DETAILED DESCRIPTION

Figure 1A:
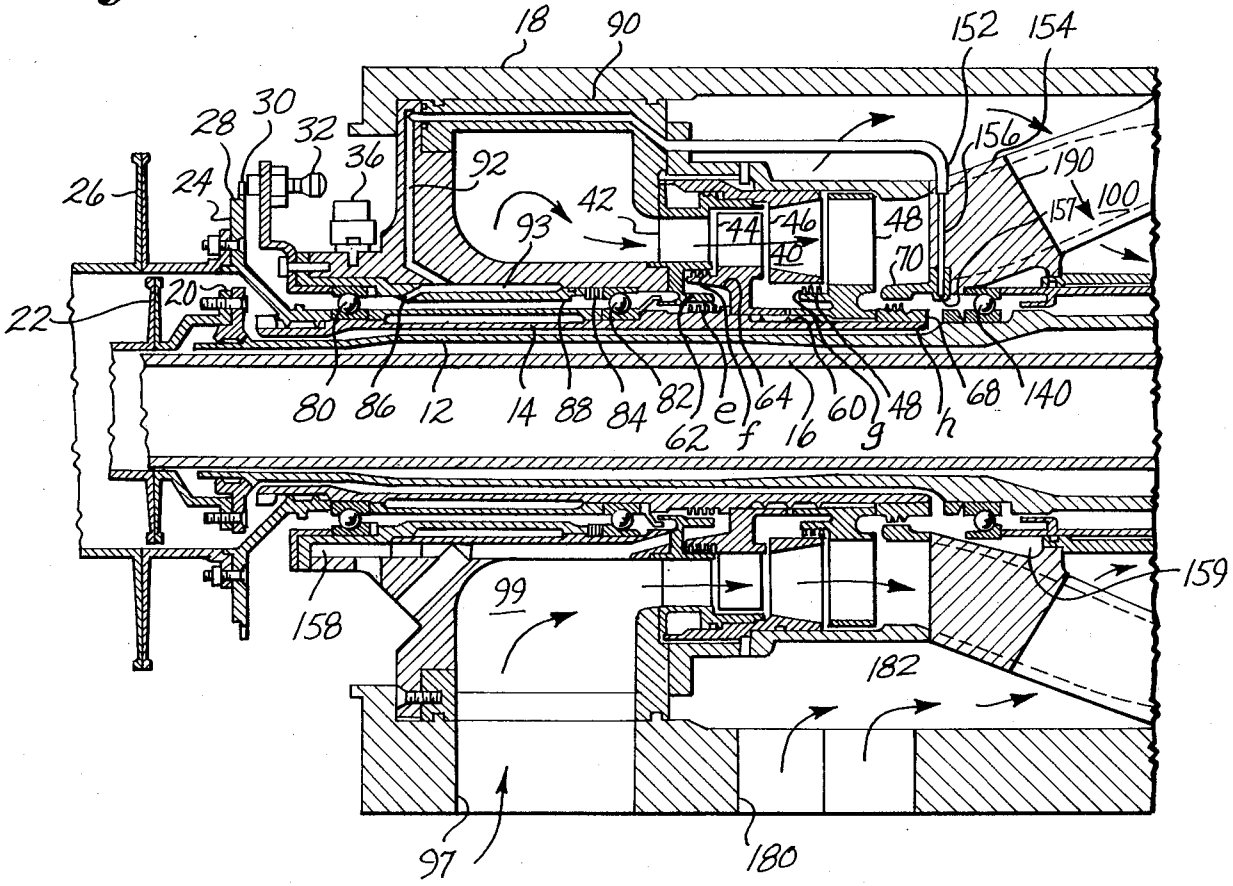
FIGS. 1A, 1B are detailed side cross-sectional views of the preferred construction of the dual turbine drive.
Figure 1B:
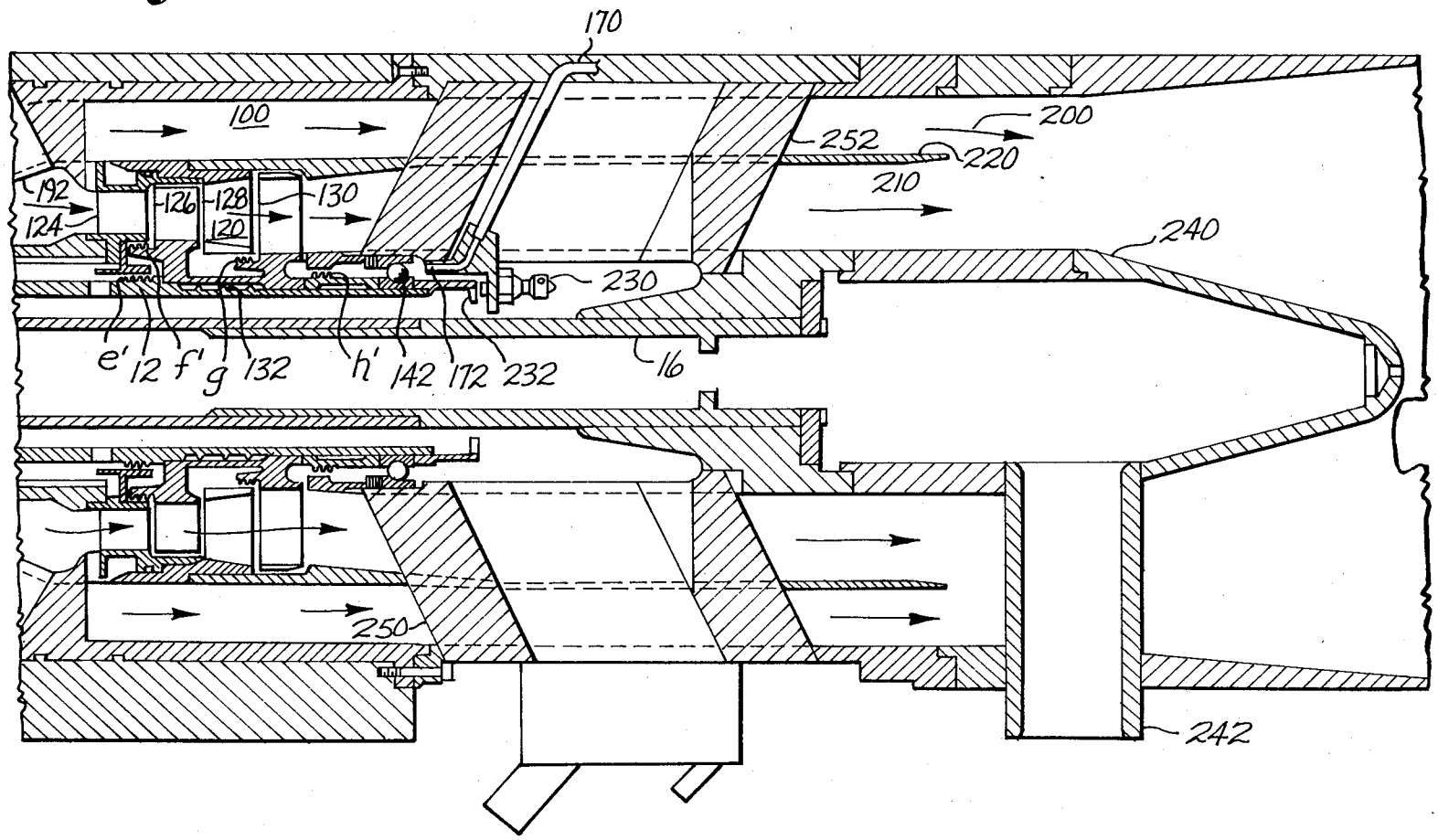

FIGS. 1A, 1B are detailed cross-sectional views, from the side illustrating the preferred construction of the dual turbine drive. The drive finds particular application in the testing of couter-rotating propellers. As such, the drive includes inner and outer coaxial drive shafts 12, 14, respectively. Coaxially aligned with the drive shafts 12, 14, and positioned within inner drive shaft 12 is a cylindrical stationary support 16 which is mechanically fixed with respect to the turbine housing 18. In application, the forward end of stationary support 16 is affixed to the nose of the counter-rotating propeller under test. Inner drive shaft 12 connects at its forward end through couplings 20,22 which connect the inner shaft 12 to one of the counter-rotating propellers (not shown). Similarly, outer drive shaft 14 connects through couplings 24, 26 to the other one of the counterrotating propellers. Projecting radially from the coupling 24 is a plate 28 which rotates with the outer drive shaft 14. A series of projecting teeth, such as tooth 30, radially extend from the plate 28 and are used in conjunction with a magnetic pickup 32, mounted in fixed position to the housing 18, to generate signals corresponding to the angular velocity of the outer drive shaft 14.

Mounted in fixed position to the housing 18 is an accelerometer 36 which is used to monitor vibration on the housing body.

A first turbine, indicated generally at 40, is mounted at the forward portion of the dual turbine drive. The first turbine comprises a first stator 42, a first rotor 44, a second stator 46, and a second rotor 48.

The configuration of each of the two turbines described with respect to the preferred embodiment shown in FIG. 1A, 1B is described in detail in U.S. patent application Ser. No. 659,995, entitled "Two-Stage Fluid Driven Turbine," invented by J. R. Anderson and S. W. Welling, and filed on the same date and assigned to the same assignee as the present application. This turbine configuration exhibits high efficiency over a broad RPM range.

Briefly, for present purposes, the first stator 42 has blades configured to provide supersonic exit velocities. The first rotor 44 is designed with highly loaded impulse blades. Two-thirds of the power developed by the turbine is produced in this first stage. The second stator 46 produces sonic exit velocities which impinge upon the high reaction type blades, designed to extract maximum available energy, of the second rotor 48.

The stators 42, 46 are fixedly mounted with respect to the housing 18 and are provided with a plurality of O-rings seals a-d to prevent leakage of the drive air.

The first and second rotors 44, 48 are affixed to the outer drive shaft 14 by means of splines 60. A series of projecting labyrinth seals e-h prevent leakage of the drive air. Labyrinth seals e project from the outer drive shaft 14 to the inner annular surface 62 on first stator 42. Labyrinth seals f project from a forward annular flange 64 on the first rotor 44 to the outer annular aft surface of stator 42. Labyrinth seals g project from a forward annular flange on the sescond rotor 48 to the outer annular surface of the second stator 46. Sealing lands h project from an aft facing annular flange 68 on rotor 48 to the annular surface 70 on housing 18.

The outer drive shaft 14 is supported from the turbine housing 18 by means of first and second 25 degree angular contact bearings 80, 82. The forward turbine 40 overhangs the bearings 80, 82 to reduce the distance between the forward and aft turbines, as well as permitting independent and isolated operation of wither turbine. Forward turbine bearing 80 is designed to accept thrust loading, with the aft bearing 82 being preloaded by means of four Belleville washers 84.

The bearings 80, 82 are lubricated by oil jets 86, 88 which are fed from a circulating oil system 90 formed within the housing 18. An oil line 92, provided in the forward portion of turbine housing 18, supplies oil to an annular gallery 93 which is positioned between the two bearings 80, 82 and supplies oil via jets 86, 88.

Inlet air to the first turbine is provided from a cold air, high-pressure source (not shown), via an inlet port 97 to an annular plenum 99 which is upstream of the forward turbine 40.

The exhaust air out of the forward turbine 40 enters an exhaust cavity 100. Exhaust cavity 100 is frusto-conical at its forward section, expanding outwardly to a cylindrical configuration around the second, or aft turbine 120 which is in-line with the first, or forward turbine 40. In fact, the outer surface 122 of the aft turbine 120 defines the inner surface for the cylindrical portion of the exhaust cavity 100. The outer surface for the exhaust cavity 100 is defined by the inside surface of the housing 18. The cross-sectional area throughout the exhaust cavity 100 is constant to minimize exhaust airflow losses.

The aft turbine 120 is identical to, and interchangeable with the first turbine, having a first stator 124, 128 are appropriately fixed to the turbine housing 18, and various seals (not shown) are provided to prevent drive-air leakage. The first and second rotors 126, 130 are coupled to the inner drive shaft 12 by means of splines 132. Various labyrinth seals e-h, similar to those descried with respect to forward turbine 40, prevent the leakage of the drive air.

The inner drive shaft 12 is supported in the housing 18 on a pair of 25 degree angular contact bearings 140, 142. The aft turbines 120 straddles these bearings.

An oil feed line 150 from the circulating oil system 90 extends to a port 152 which is formed at the forward portion of a strut 154. In the preferred embodiment, six struts, such as strut 154, are provided, each strut 154 projecting radially in the frusto-conical section of exhaust cavity 100. A passageway 156 is provided down through the forward end of at least two of the struts 154 to feed oil to an oil jet 157 which provides lubrication to the bearing 140.

Similarly, a lubrication feed line 170, which connects with the circulating oil supply, feeds oil to an oil jet 172 to provide lubrication to the bearing 142.

An oil scavenge system including cavities 158, 159 are configured to operate in any attitude.

Input cold drive air to the second, aft turbine 120 is routed via an inlet port 180 to an annular plenum 182 surrounds the forward turbine 40.

Inlet air to the aft turbine 120 routes via the inlet port 180 to the annular plenum 182 surrounding the forward turbine 40 and then through inlet air ducts 190 provided as hollowed out sections in each strut 154 to a second annular plenum 192 and thence to the first stator 124. A better understanding of the flow of both the exhaust air from the first, forward turbine 40 and the inlet drive air to the aft turbine 120 may be had with reference to FIG. 2.

Figure 2:
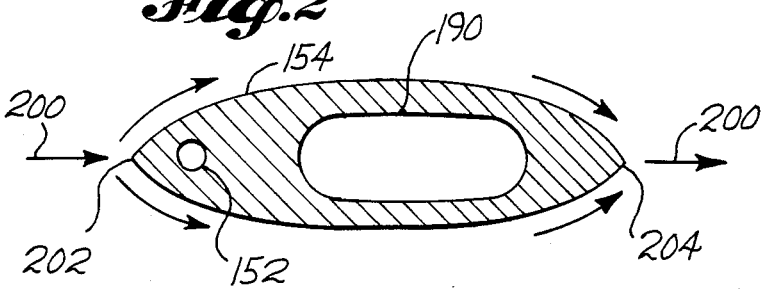
FIG. 2 is a top cross-sectional view illustrating one of the struts shown in FIGS. 1A, 1B.

FIG. 2 is a cross-sectional top view, taken at a radius, of one of the struts 154. Shown provided in the forward portion of strut 154 is the oil port 152. Strut 154 is hallowed, with its inner cavity defining the inlet air duct 190 for inlet air to the second turbine. Thus, inlet air to the second turbine flows down into the duct 190, whereas exhaust air from the forward turbine 40 flows around each strut 154, as indicated by arrows 200. To minimize exhaust airflow losses, the exterior coutour of the strut 154 is aerodynamically designed, having a forward edge 202 and a trailing edge 204, with tapered coutours therebetween.

Referring again to FIGS. 1A, 1B, the exhaust air from the forward turbine, indicated by arrows 200, is separated from the exhaust air out of the aft turbine, indicated by arrows 210, via a cylindrical splitter 220 which extends rearwardly from the aft end of the aft turbine 120. The cylindrical splitter 220 minimizes the interaction between the exhausts 200, 210 thereby preventing the exhaust of one turbine from producing an adverse effect in the operation of the other turbine.

A magnetic pickup 230 is mounted to the housing in a position to monitor the angular rotation of the inner shaft 12, via a fingered flange 232 which projects radially from the inner drive shaft 12.

The stationary inner support shaft 16 terminated at a plug section 240 which is hollow and receives leads used to monitor operation of the turbine and the propeller under test via an instrumentation tube 242.

Four struts (two of which are shown at 250, 252) are used to secure the outer perimeter of the housing 18 to the fixed inner structure, including the plug 240 and the stationary shaft 16.

In summary, an improved dual drive turbine has been described in detail. The dual drive turbine employs a pair of in-line, high-efficiency turbines to drive a pair of coaxial drive shafts. Each drive shaft is independently supported on bearings, and the direction and rate of rotation of each drive shaft may be independently controlled. The unique configuration of the two turbines and the routing of turbines inlet and exhaust air allows the disclosed dual turbine to be confugered in a compact package which may be positioned directly behind a driven counter-rotating propeller without adversely obstructing propeller airflow measurements. In addition, the cold-air-driven turbines employed produce a useful power output over a broad RPM range with a minimum of generated noise.

While a preferred embodiment of the invention has been described in detail, it should be apparent that many modifications and variations thereto are possible, all of which fall within the true spirit and scope of the invention.

We claim:

1. A dual turbine drive comprising:

first and second coaxial drive shafts, each drive shaft adapted to be coupled to an external load, first and second fluid drive turbines;

a housing for said drive shafts and said turbines;

means for connecting the output power produced by said first turbine to said first drive shaft;

means for connecting the output power produced by said second turbine to said second drive shaft;

said first and second turbines being configured in-line along said drive shafts with said first turbine forward of said second turbine;

first turbine exhaust means for routing the exhaust from said first turbine to a port aft of said second turbine, said first turbine exhaust means including an exhaust cavity defined at its inner surface by the inner surface of said housing; and first and second distinct inlet means, including first and second distinct inlet ports accessible on the outside of said housing, for independently routing inlet driving fluid to each of said first and second turbines, said second inlet means including duct means extending from the inlet of said second turbine through said first turbine exhaust cavity to said second inlet port, such that each turbine is independently operable from the other turbine.

2. The dual turbine of claim 1 wherein:

said exhaust cavity is annular is cross section with a substantially constant cross sectional area extending frusto-conically from the output of said first turbine to a substantially cylindrical configuration around said second turbine.

3. The dual turbine of claim 2 wherein:

said second inlet means comprises a plurality of radial struts positioned intermediate said turbines and substantially within the frusto-conical portion of said exhaust cavity, each strut having a provided fluid duct for routing inlet fluid drive to said second turbine.

4. The dual turbine drive of claim 3 wherein:

each of said struts has an aerodynamically contoured outer surface for minimizing exhaust flow losses of said first turbine through said exhaust cavity.

5. The dual turbine of claim 1 further comprising:

first and second bearing sets for independently supporting said first and second drive shafts, respectively, such that the direction and speed of rotation of the shafts are independent.

6. The dual turbine drive of claim 3 further comprising:

first and second bearing sets for independently supporting said first and second drive shafts, respectively, such that the direction and speed of rotation of the shafts are independent.

7. The dual turbine drive of claim 6 wherein:

at least one of said struts includes a provided lubricant flow path for routing lubricant to at least a portion of said bearing sets.

8. The dual turbine drive of claim 1 further comprising:

an exhaust splitter means for limiting the interaction between the exhausts from said turbines.

9. The dual turbine drive of claim 2 further comprising: a cylindrical exhaust splitter extending aft from the exhaust duct of said second turbine for limiting the interaction between the exhaust gasses from said turbines.

* * * * *